US009796546B1

(12) United States Patent
LeFevre et al.

(10) Patent No.: US 9,796,546 B1
(45) Date of Patent: Oct. 24, 2017

(54) VACUUM BELT SYSTEM HAVING INTERNAL ROTARY VALVE

(71) Applicant: Xerox Corporation, Norwalk, CT (US)

(72) Inventors: Jason M. LeFevre, Penfield, NY (US); Douglas K. Herrmann, Webster, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/200,047

(22) Filed: Jul. 1, 2016

(51) Int. Cl.

| | |
|---|---|
| ***B65H 5/02*** | (2006.01) |
| ***B65H 5/04*** | (2006.01) |
| ***B65H 5/22*** | (2006.01) |
| ***B65H 11/00*** | (2006.01) |

(52) U.S. Cl.
CPC ..... *B65H 5/224* (2013.01); *B65H 11/005* (2013.01); *B65H 2406/32* (2013.01); *B65H 2406/322* (2013.01); *B65H 2406/3221* (2013.01); *B65H 2406/3222* (2013.01); *B65H 2406/36* (2013.01)

(58) Field of Classification Search
CPC ..... B65H 5/021; B65H 5/22; B65H 5/222; B65H 5/224; B65H 11/002; B65H 11/005; B65H 2301/44336; B65H 2301/44735; B65H 2406/30; B65H 2406/31; B65H 2406/3124; B65H 2406/32; B65H 2406/321; B65H 2406/322; B65H 2406/3221; B65H 2406/3222; B65H 2406/36; B65H 2406/361; B65H 2406/3612; B65H 2406/3614; B65H 2406/362; B65H 2406/3622; B65H 2406/40; B65H 2406/41; B65H 2406/411
USPC ..... 137/625.15, 625.16, 907
See application file for complete search history.

(56) References Cited

U.S. PATENT DOCUMENTS

| | | | | |
|---|---|---|---|---|
| 4,298,277 | A | 11/1981 | Silverberg | |
| 4,825,255 | A | 4/1989 | Iaia, Jr. et al. | |
| 5,671,300 | A | 9/1997 | Adachi | |
| 5,921,544 | A | 7/1999 | Benedict | |
| 5,967,507 | A | 10/1999 | Moore et al. | |
| 5,967,510 | A | 10/1999 | Ono et al. | |
| 6,027,112 | A | 2/2000 | Guenther et al. | |
| 6,047,733 | A * | 4/2000 | Blake | G03B 27/60 137/625.12 |
| 6,182,697 | B1 * | 2/2001 | Parker | F15B 13/01 137/625.16 |

(Continued)

*Primary Examiner* — Prasad Gokhale
(74) *Attorney, Agent, or Firm* — Gibb & Riley, LLC

(57) ABSTRACT

A vacuum belt moves between a print head and a manifold. The manifold has manifold chambers, and each of the manifold chambers has manifold openings. Vacuum lines are connected to the manifold chambers. The vacuum lines exert vacuum force upon the manifold chambers, and the manifold openings exert the vacuum force through belt perforations. A cylindrical valve structure is connected to the vacuum lines. The cylindrical valve structure includes a cylindrical sleeve (having sleeve openings connected to the vacuum lines) and an internal valve cylinder positioned within the cylindrical sleeve. The internal valve cylinder has groups of vacuum slots. The internal valve cylinder moves linearly within the cylindrical sleeve (in directions parallel to cylindrical walls of the cylindrical sleeve) to align only one of the groups of vacuum slots with the sleeve openings at a time, so as to control which of the manifold chambers receive the vacuum draw.

20 Claims, 5 Drawing Sheets

(56) References Cited

U.S. PATENT DOCUMENTS

| | | | | |
|---|---|---|---|---|
| 6,209,867 | B1 * | 4/2001 | Madsen | B41J 11/0025 271/183 |
| 6,543,948 | B2 | 4/2003 | Beehler et al. | |
| 7,922,174 | B2 | 4/2011 | Panides et al. | |
| 7,980,558 | B2 | 7/2011 | Moore et al. | |
| 8,052,146 | B2 | 11/2011 | Sugiyama et al. | |
| 8,177,231 | B2 * | 5/2012 | Fukui | B65H 27/00 271/194 |
| 8,186,675 | B2 | 5/2012 | Zirilli | |
| 8,220,919 | B2 * | 7/2012 | DeGruchy | B41J 11/007 347/104 |
| 8,544,842 | B2 | 10/2013 | Schulze-Hagenest et al. | |
| 8,708,135 | B2 | 4/2014 | Lin et al. | |
| 2015/0259144 | A1 * | 9/2015 | Hershfeld | B31B 1/88 347/104 |

* cited by examiner

VACUUM BELT SYSTEM HAVING INTERNAL ROTARY VALVE

BACKGROUND

Devices and methods herein generally relate to sheet transport devices, and more particularly to vacuum transport belt systems.

Various printer systems use vacuum transport belts to hold down and transport print media past print heads. Airflow disturbances at the inter-copy gap (ICG) from the vacuum system can cause leading edge and trailing edge (of the print media) disturbances that affect ink droplet placement and degrade the overall print quality. In other words, the vacuum holes at the leading edge and trailing edge gaps of the print media sheets can draw air from under the print heads and disturb the ink droplet dispersion, decreasing print quality.

SUMMARY

Exemplary printing devices herein include, among other components, a print head, and a vacuum belt (having belt perforations) adjacent the print head. The vacuum belt moves past the print head to transport print media past the print head, and the print media is held on the vacuum belt by vacuum force exerted from the belt perforations.

Additionally, a manifold is positioned adjacent the vacuum belt. The vacuum belt moves between the print head and the manifold. The manifold has manifold chambers, and each of the manifold chambers has manifold openings. Also, vacuum lines are connected to the manifold chambers. The vacuum lines exert the vacuum force upon the manifold chambers, and the manifold openings exert the vacuum force through the belt perforations.

With these structures, a cylindrical valve structure is connected to the vacuum lines. The cylindrical valve structure includes a cylindrical sleeve (having sleeve openings connected to the vacuum lines) and an internal valve cylinder positioned within the cylindrical sleeve. The internal valve cylinder has groups of vacuum slots. The vacuum lines only receive the vacuum force from the sleeve openings that are aligned with the vacuum slots. The internal valve cylinder moves linearly within the cylindrical sleeve (in directions parallel to cylindrical walls of the cylindrical sleeve) to align only one of the groups of vacuum slots with the sleeve openings at a time, so as to control which of the manifold chambers receive the vacuum draw.

In addition to moving linearly within the cylindrical sleeve, the internal valve cylinder also rotates within the cylindrical sleeve (in coordination with movement of the vacuum belt past the manifold) to limit supply of the vacuum force to only the belt perforations where the print media is held on the vacuum belt, so as to not provide the vacuum force to inter-document zones (IDZs) of the vacuum belt. Such rotation and linear movement of the internal valve cylinder within the cylindrical sleeve controls alignment of the sleeve openings with the vacuum slots, and thereby controls which of the manifold chambers receive the vacuum force.

Such structures also include gaskets positioned on lateral surfaces of the internal valve cylinder between each of the groups of vacuum slots. The gaskets extend between the internal valve cylinder and the cylindrical sleeve to seal the groups of vacuum slots from each other. Additionally, a vacuum source is connected to the internal valve cylinder. The vacuum source exerts the vacuum force upon the groups of the vacuum slots.

Such structures promote the performance of unique methods, including generally, methods that move a vacuum belt having belt perforations past a print head to transport print media past the print head. Again, the print media is held on the vacuum belt by vacuum force exerted from the belt perforations. The process of moving the vacuum belt moves the vacuum belt by a manifold. As discussed above, the manifold has manifold chambers, each of the manifold chambers has manifold openings, and vacuum lines are connected to the manifold chambers. The vacuum lines exert the vacuum force upon the manifold chambers, and the manifold openings exert the vacuum force through the belt perforations.

These methods linearly move an internal valve cylinder within a cylindrical sleeve. Again, the cylindrical sleeve has sleeve openings connected to the vacuum lines, and the internal valve cylinder has groups of vacuum slots exerting the vacuum force upon the vacuum lines through the sleeve openings. The process of linearly moving the internal valve cylinder moves the internal valve cylinder within the cylindrical sleeve in directions parallel to cylindrical walls of the cylindrical sleeve to align only one of the groups of vacuum slots with the sleeve openings at a time, to thereby control which of the manifold chambers receive the vacuum draw.

Further, such methods also rotate the internal valve cylinder within the cylindrical sleeve, in coordination with movement of the vacuum belt past the manifold, to limit supply of the vacuum force to only the belt perforations where the print media is held on the vacuum belt, so as to not provide the vacuum force to IDZs of the vacuum belt.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
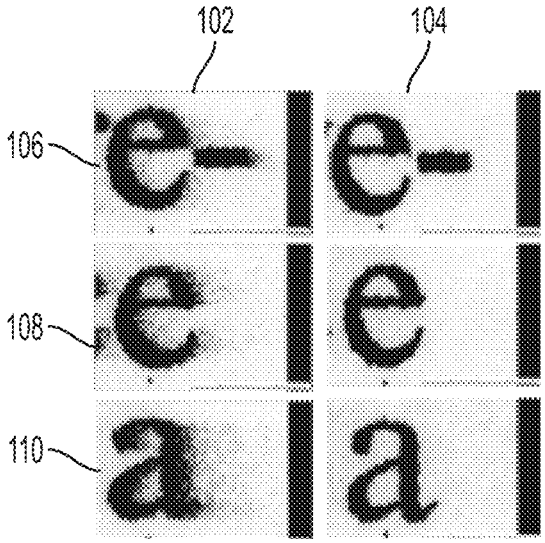
FIG. 1 is a schematic diagram illustrating printing output.

Within printers, airflow disturbances at the inter-copy gap (ICG) from a vacuum system can cause leading edge and trailing edge (of the print media) disturbances that affect ink drop placement and degrade print quality. FIG. 1 illustrates undesirable effects of air being drawn into vacuum holes that are close to the trailing or leading edges of the media, where column 102 illustrates the effects of air being drawn into vacuum holes adjacent the trailing edge of a sheet of media, and column 104 illustrates the effects of the devices and methods herein, which prevent air from being drawn into vacuum holes that are close to the trailing or leading edges of the sheet of media.

In FIG. 1, row 106 illustrates the outboard portion a sheet of media, row 108 illustrates the center of the sheet of media, and row 110 illustrates the inboard edge of the sheet of media. As can be seen in column 102 of FIG. 1, the airflow from the vacuum holes creates turbulence around the jets, and the ink droplets are deflected from their intended trajectory, shown in the increased blurring in column 102 (which is contrasted by the systems and devices herein, which produce the clearer results shown in column 104 in FIG. 1).

Figure 2:
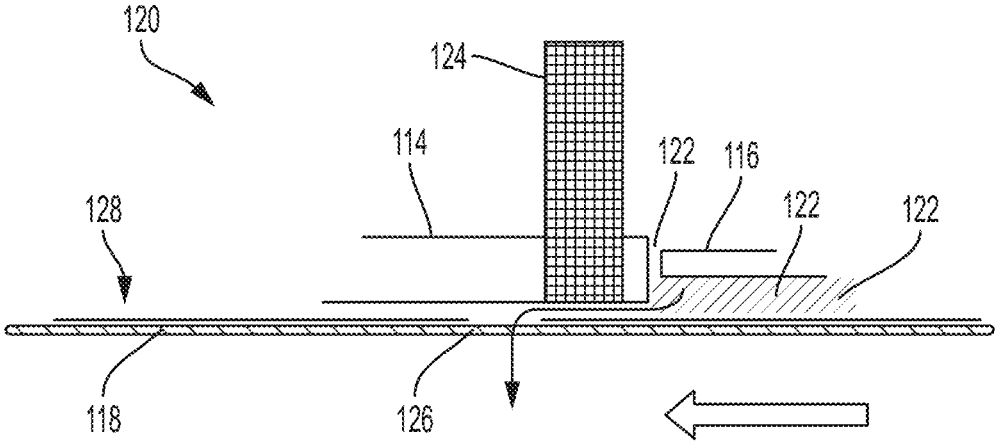
FIG. 2-3 are a side-view schematic diagrams illustrating printing devices.

FIG. 2 is a side-view schematic diagram illustrating a portion of a printing device 120. The print head 124 is supported in a frame 114, along with a baseplate 116. The air drawn by the vacuum belt 118 is shown as items 122, and such air 122 is drawn through the open areas to the inter-copy gap 126 between the sheet of media 128, causing disturbances at the leading and trailing ends of the sheet of media 128. FIG. 2 shows that the air disturbance 122 flows down through the inter-copy gap 126 between the sheets of print media 128, and causes the undesirable ink droplets deflection illustrated in column 102 in FIG. 1.

Thus, for print engine systems that use a vacuum belt to transport the media under an ink jet print system, the area where no sheet is present (at the inter-copy gap 126) creates unwanted airflow 122 by the print heads 124. This airflow 122 creates turbulence around the jets, and the ink droplets are deflected from their intended trajectory, which leads to degraded print accuracy and a distorted image. With no media to block the airflow 122 caused by the vacuum, the air is pulled by the ink jet head 124 and this air velocity 122 causes dispersion of the jetted ink droplets between the head 124 and the sheet 128. This error is in evidence at both the leading edge and trailing edge of the print media sheets, and can been in column 102 in FIG. 1.

The print media sheet 128 however needs to have vacuum up to the edges, so a permanent change in the underlying plenum would prevent any vacuum under the print head 124, which might lead to the print media separating from the belt in the area of the print head 124, and create an uneven print surface. The devices and methods described below control the vacuum to be present only under the media 128, and not at the inter-copy gap 126, using a rotary vacuum valve system.

Figure 3:
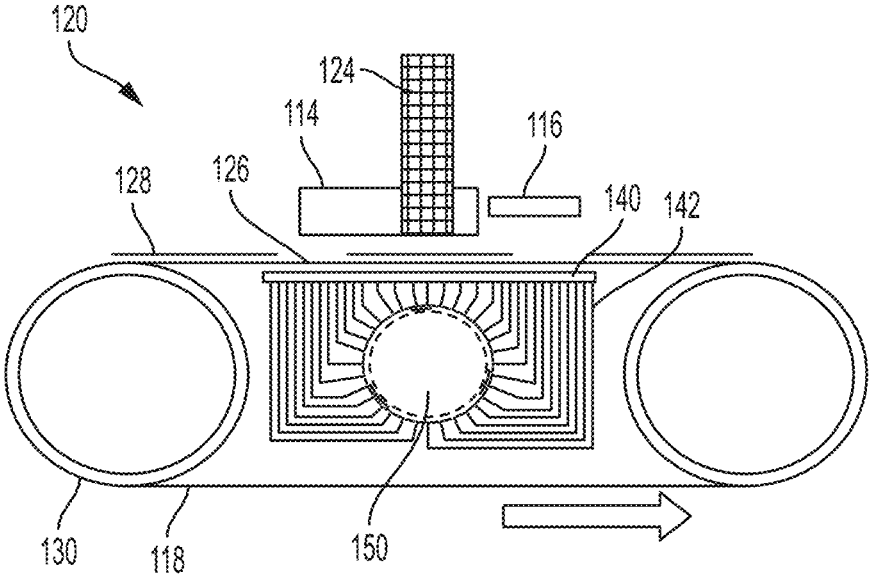
Figure 4:
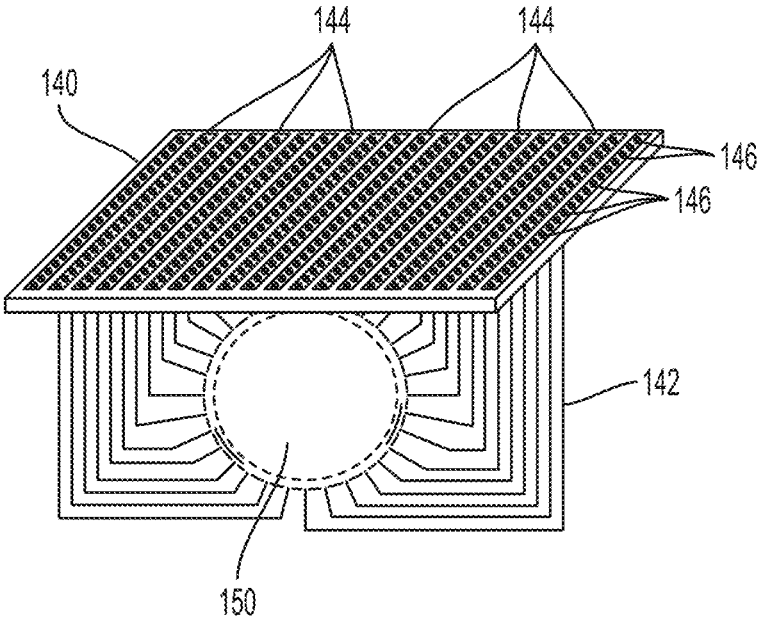
FIG. 4-5 are a perspective-view schematic diagrams illustrating vacuum systems.
Figure 5:
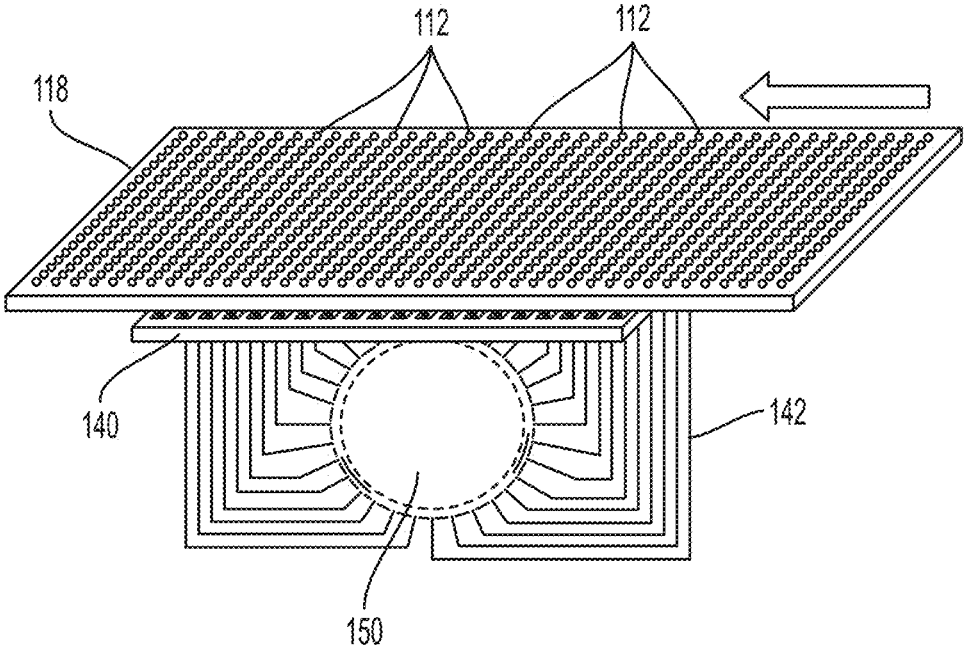
Figure 6:
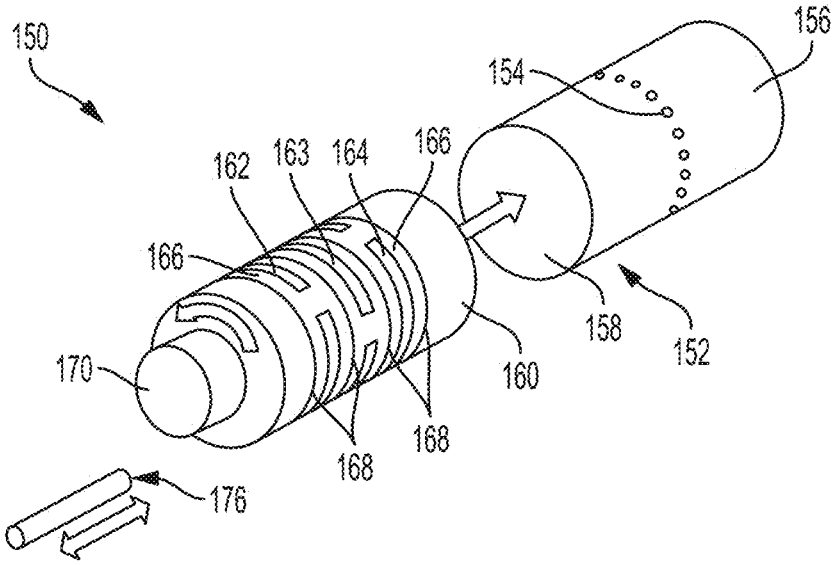
FIG. 6 is a perspective-view schematic diagram illustrating a rotary valve.

As shown in FIG. 3, in order to prevent the unwanted airflow 122 by the print heads 124, a rotary valve 150, air distribution network 142, and vacuum platen 140 are utilized by structures herein. To illustrate the features shown in FIG. 3 more clearly, FIG. 4 shows only the a rotary valve 150, air distribution network 142, and vacuum platen 140 in perspective view; FIG. 5 illustrates that shown in FIG. 4, with the vacuum belt 118 moving over the vacuum platen 140; and FIG. 6 illustrates the rotary valve 150 in greater detail from a perspective, exploded isometric view. FIGS. 3-6 are discussed together below to provide a unified discussion of the structures herein.

As shown in FIGS. 3-6, the vacuum platen 140 is sectioned into a number of discrete airtight vacuum sections 144. The vacuum belt 118 shown in FIG. 5 (e.g., which can be mylar or any other similar material) has a uniform array of perforated holes 112 and runs over the top of this vacuum platen 140. The rotary valve 150 delivers a timed vacuum sequence to the array of discrete sections 144 in the vacuum platen 140 through the air distribution network 142.

As shown in FIG. 6, the rotary valve 150 has a stationary outer sleeve 152, which has a plurality of ports 154 located in equal intervals radially, such that the total number of ports 154 on the valve 150 is equal to the total number of vacuum zones 144 in the vacuum platen 140. As shown in FIGS. 3-6, the air distribution network 142 connects each one of the ports 154 on the outer sleeve 152 with its corresponding vacuum zone 144 on the vacuum platen 140, using a dedicated vacuum line 142. The rotary valve 150 has a rotating inner sleeve 160, which is connected directly or indirectly to a drive axis of the rollers 130 driving the vacuum belt 118. As shown in FIG. 6, a bulk vacuum source 170 is connected to the inner sleeve 160 to supply vacuum force to slots 162-164.

FIG. 6 illustrates that there are a series of slots 162-164 in the inner sleeve 160 that generate a timing sequence for a given paper size and inter-document zone (IDZ). Thus, the rotating inner sleeve 160 has "sets" of slots (the three different sets of slots that are illustrated in FIG. 6 are numbered 162, 163, 164) located axially, which correspond to different configurations of paper length (process-direction) and IDZ spacing. The inner sleeve 160 can be shifted axially, as shown by the linear arrow in FIG. 6, depending on what size paper is being used on the vacuum platen to accommodate for different paper lengths and IDZ's.

A sealing surface 168 (O-ring, or similar) is positioned between each set of slots 162-164 to provide vacuum separation between the sets of slots 162-164. When the two sleeves 152, 160 are assembled together, a single set of slots 162, 163, or 164 in the inner sleeve 160 is aligned axially with the ports 154 (holes) in the outer sleeve 152, depending on the sheet length and IDZ required at a given period of time.

Accordingly, when the appropriate slots 162-164 on the inner sleeve 160 are aligned with the ports 154 on the outer sleeve 152, vacuum passes through to only the outer ports 154 (and the corresponding zones 144 on the vacuum platen 140) which the media 128 is covering, and vacuum does not pass to the IDZ. The media 128 is introduced to vacuum belt 118 such that each sheet is synchronized to the "zones" of vacuum provided by each of the zones of the vacuum platen 140. In this way the sheet 128 is held-down in the areas of vacuum, and the IDZ do not receive any vacuum. Since the IDZ zones do not receive any vacuum, there is no unwanted airflow around the print head jets 124, and the ink jet droplets are no longer deflected from their intended trajectory.

Thus, as shown above, the vacuum belt 118 moves past the print head 124 to transport print media 128 past the print head 124, and the print media 128 is held on the vacuum belt 118 by vacuum forces (e.g., suction, draw, airflow, etc.) exerted from the belt perforations 112. Additionally, the vacuum platen (sometimes referred to as a manifold) 140 is positioned adjacent the vacuum belt 118. The vacuum belt 118 moves in the processing direction (as driven by the rollers 130) past the print head 124 by moving between the print head 124 and the manifold 140. The processing direction is parallel to the direction in which the vacuum belt 118 moves when transporting the sheets of media 128, and is also parallel to the plane of the vacuum belt 118 that is between the rollers 130. The manifold 140, rotary valve 150, and vacuum lines 142, can be made of any appropriate material (e.g., plastics, metals, rubbers, ceramics, etc.) depending upon cost, durability requirements, etc.

The manifold 140 has sections or zones (sometimes referred to as manifold chambers) 144, and each of the manifold chambers 144 has manifold openings 146. Each of the manifold chambers 144 is separate and airtight from the other manifold chambers 144. Also, each manifold chamber 144 runs the full width of the vacuum belt 118 in the cross-processing direction. The cross-processing direction is perpendicular to the direction in which the vacuum belt 118 moves when transporting the sheets of media 128, while still being parallel to the plane of the vacuum belt 118 that is between the rollers 130. The manifold openings 146 of each manifold chamber 144 are therefore positioned in a line that is perpendicular to the processing direction.

In other words, each individual manifold chamber 144 is a linear element (closed tube, closed cylinder, closed rectangular box, etc.) that includes a single vacuum line connection or opening on one side (e.g., the bottom) of the manifold 140, which is connected to only one of the vacuum lines 142; and multiple manifold openings 146 on the other side (e.g., the top) of the manifold 140. The air distribution network (sometimes referred to as vacuum lines) 142 is connected to the bottom of the manifold chambers 144. The vacuum lines 142 exert (provide, draw, supply etc.) the vacuum force upon (into, from, through, etc.) the manifold chambers 144, and the manifold openings 146 exert the vacuum force upon the belt perforations 112.

Therefore, the manifold openings 146 on the top of the manifold 140 allow the vacuum force exerted within the vacuum line 142, connected to the bottom of each manifold chamber 144, to be applied to the perforations 112 of the vacuum belt 118. Further, the selective application of the vacuum force by the rotary valve 150 to each of the vacuum lines 142 controls which of the manifold chambers 144 will exert the vacuum force to the perforations 112 of the vacuum belt 118.

With these structures, the cylindrical valve structure 150 is connected to the vacuum lines 142. The cylindrical valve structure 150 includes an outer sleeve (sometimes referred to as a cylindrical sleeve) 152. The cylindrical sleeve 152 includes a rounded body 156, an open end 158, and a closed end opposite the open end 158. The single ring of ports (sometimes referred to as sleeve openings) 154 on the rounded body 156 of the cylindrical sleeve 152 are connected to the vacuum lines 142. The inner sleeve (sometimes referred to as an internal valve cylinder) 160 is positioned within the cylindrical sleeve 152, and moves in and out of the open end 158 of the cylindrical sleeve 152.

Any mechanism can be utilized to linearly move the internal valve cylinder 160 within the cylindrical sleeve 152, including stepper motors, pneumatic devices, hydraulic devices, magnetic devices, etc., which are illustrated by element 176 in FIG. 6. In one example, the internal valve cylinder 160 can be spring-loaded within the cylindrical sleeve 152 (e.g., a spring at the closed end of the cylindrical sleeve can bias the internal valve cylinder 160 outward from the cylindrical sleeve 152), while the actuator 176 pushes the internal valve cylinder 160 into the cylindrical sleeve 152 to adjust the amount that the internal valve cylinder 160 extends into the cylindrical sleeve 152. Movement of the internal valve cylinder 160 within the cylindrical sleeve 152 can optionally be limited by mechanical stops, etc.

The internal valve cylinder 160 also includes a rounded body 166, and two closed ends, one of which includes a vacuum connection connected to a vacuum source 170. Sets of grooves, trenches, recesses, or slots 162-164 are recessed into the rounded body 166 of the internal valve cylinder, and therefore, the sets of slots 162-164 have a smaller radius relative to the rounded body 166, and can comprise holes into the center of the internal valve cylinder 160.

The number of manifold chambers 144 is equal to the number of vacuum lines 142, and each manifold chamber 144 therefore includes a dedicated vacuum line 142, and a dedicated sleeve opening 154. Thus, there is just a single ring of sleeve openings 154 around the rounded body 156 of the cylindrical sleeve 152. The number of such sleeve openings 154 equals the number of vacuum lines 142 and the number of manifold chambers 144.

Such structures also include gaskets 168 positioned on lateral surfaces of the internal valve cylinder 160 between or around each of the groups of vacuum slots 162-164. In some structures, the gaskets 168 are positioned to surround each individual slot 162-164. The gaskets 168 extend between the internal valve cylinder 160 and the cylindrical sleeve 152 to seal the groups of vacuum slots 162-164 from each other (or to seal each slot individually, if each slot includes a dedicated seal).

Thus, while a single dedicated vacuum line 142 will supply vacuum force from a single dedicated sleeve opening 154 (as controlled by the position of one of the slots 162-164) to a given manifold chamber 144, the cross-process direction manifold chamber 144 distributes the vacuum force to the full width of the vacuum belt 118 through the manifold openings 146, along the line of the manifold openings that is in the cross-processing direction. Therefore, some manifold chambers 144 that are beneath sheets of media 128 will be exerting the vacuum force, while others that are in the inter-document zone 126 will not be exerting the vacuum force, based upon to which vacuum lines 142 the slots 162-164 rotating past the sleeve openings 154 supply the vacuum force.

Figure 7:
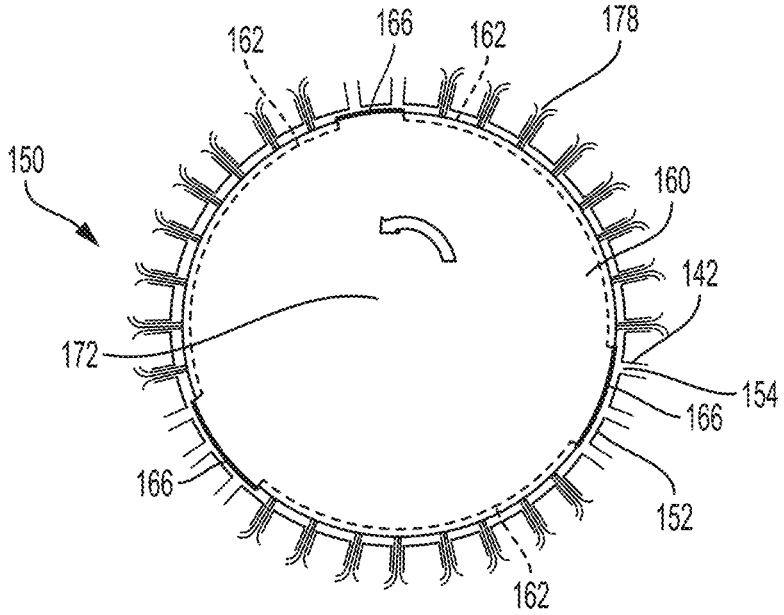
FIG. 7-8 are a side-view schematic diagrams illustrating a rotary valve.
Figure 8:
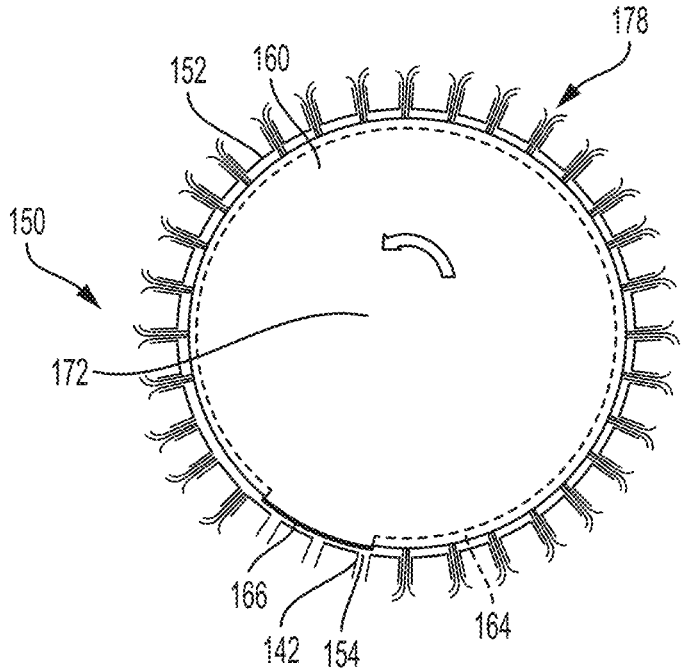

FIGS. 7-8 provide schematic examples of the rotary valve timing system for two different paper sizes. Any combination of media 128 length and inter-document zone can be accommodated by the structures disclosed herein. The bulk vacuum source applied to the inner sleeve 160 is distributed through to the vacuum ports 154 corresponding to the appropriate areas of the vacuum platen 140 in which the media 128 is located.

As shown in FIG. 6, a vacuum source 170 is connected to one of the ends of the internal valve cylinder 160, and this connection seals that end of the internal valve cylinder 160. This creates a vacuum chamber (shown as item 172 in FIGS. 7-8) within the rounded body 166 and the two the closed ends of the internal valve cylinder 160.

The internal valve cylinder 160 and groups of vacuum slots 162-164 that are connected to the vacuum chamber 172 of the internal valve cylinder 160, are shown in cross-section in FIGS. 7-8. The vacuum source 170 exerts the vacuum force 178 upon the groups of the vacuum slots 162-164 by supplying the vacuum force 178 to the internal vacuum chamber 172 of the internal valve cylinder 160. FIGS. 7 and 8 also illustrate, in cross-section, vacuum lines 142 connected to the sleeve openings 154, and show that the rounded body 166 blocks the sleeve openings 154 from receiving the vacuum force 178.

Thus, the vacuum lines 142 only receive the vacuum force 178 from the sleeve openings 154 that are aligned with the vacuum slots 162-164, and do not receive the vacuum force 178 from the sleeve openings 154 that are blocked by the rounded body 166, because the outer curved surface 166 of the internal valve cylinder 160 contacts (or has a very tight tolerance (e.g., less than 0.5 mm, 0.1 mm, 0.01 mm, etc.) with) the inner surface of the cylindrical sleeve 152, thereby blocking the sleeve openings 154 from receiving the vacuum force 178.

As shown in FIG. 6, the internal valve cylinder 160 moves linearly within the cylindrical sleeve 152 (in directions parallel to the axis about which the internal valve cylinder 160 rotates, which is parallel to the cylindrical walls of the cylindrical sleeve 152) to align only one of the groups of vacuum slots 162-164 with the single ring of sleeve openings 154 at a time, so as to determine which slots 162-164 are used to control which manifold chambers 144 receive the vacuum draw, and ultimately which of the perforations 112 receive the vacuum force 178 (and thereby prevent the vacuum force 178 from being applied to the gaps 126 between the sheets of media 128 on the vacuum belt 118).

However, in addition to moving linearly within (in and out of) the cylindrical sleeve 152 to choose one of the vacuum slot groups 162-164, the internal valve cylinder 160 also rotates within the fixed-position cylindrical sleeve 152 (in coordination with movement of the vacuum belt 118 past the manifold 140), as shown in FIGS. 7 and 8, to limit supply of the vacuum force 178 to only the belt perforations 112 where the print media 128 is held on the vacuum belt 118, and so as to not provide the vacuum force 178 to inter-document zones 126 of the vacuum belt 118. In other words, as the internal valve cylinder 160 rotates within the fixed-position cylindrical sleeve 152, the rounded body 166 blocks different vacuum lines 142 from receiving the vacuum force 178, and the vacuum lines 142 that are blocked by the rounded body 166 correspond to manifold chambers 144 that are in the inter-document zone 126.

The elements that control the speed of the vacuum belt 118 similarly control the speed at which the internal valve cylinder 160 rotates within the cylindrical sleeve 152 (either by mechanical connections, electrical connections, or otherwise) to have the rotation of the internal valve cylinder 160 match the movement of the vacuum belt 118. Therefore, as the sheets of media 128 are transported by the moving vacuum belt 118 and the location of the inter-document zones 126 change relative to the fixed positions of the manifold chambers 144, the rotation of the internal valve cylinder 160 within the cylindrical sleeve 152 moves the location of the rounded body 166 to block the vacuum force 178 from being supplied through the vacuum lines 142 to the manifold chambers 144 that are within the inter-document zone 126.

Different spacing between the sheets of media 128 and different lengths of sheets of media 128 will result in different locations for the inter-document zones 126 on the vacuum belt 118. Therefore, the internal valve cylinder 160 includes a number of different groups of vacuum slots 162-164, that have different slot lengths (different slot sizes) and different spacing of rounded body 166 portions between the slots 162-164 (different inter-slot spacings). For example, FIG. 7 illustrates one group of three slots 162 separated by three portions of the rounded body 166; while FIG. 8 illustrates a single, longer slot 164 bounded by a single portion of the rounded body 166. The group of slots 162 illustrated in FIG. 7 would be utilized for shorter sheets of media, while the longer slot 164 illustrated in FIG. 8 would be utilized for longer sheets of media. The different groups of slots 162, 164 illustrated in FIGS. 7 and 8 are selected by linearly moving the internal valve cylinder 160 partially in or out of the cylindrical sleeve 152 to position such different groups of slots 162, 164 adjacent to the sleeve openings 154.

Thus, the linear movement of the internal valve cylinder 160 within the cylindrical sleeve 152 aligns different groups of slots 162-164 with the sleeve openings 154 to allow different length slots (having different inter-slot spacings) to be selected so as to accommodate differently spaced and located inter-document zones 126 caused by differently sized and spaced sheets of media 128 on the vacuum belt 118. While the linear movement of the internal valve cylinder within the cylindrical sleeve 152 aligns different groups of slots 162-164 with the sleeve openings 154 to accommodate different sized and spaced sheets, the rotation of the internal valve cylinder 160 within the cylindrical sleeve 152 coordinates timing of the vacuum force to the manifold chambers 144 that are in the inter-document zone. Such rotation and linear movement of the internal valve cylinder 160 within the cylindrical sleeve 152 controls alignment of the sleeve openings 154 with the vacuum slots 162-164, and thereby controls when the different manifold chambers 144 receive the vacuum force 178 to avoid applying vacuum force to the inter-document zone.

Figure 9:
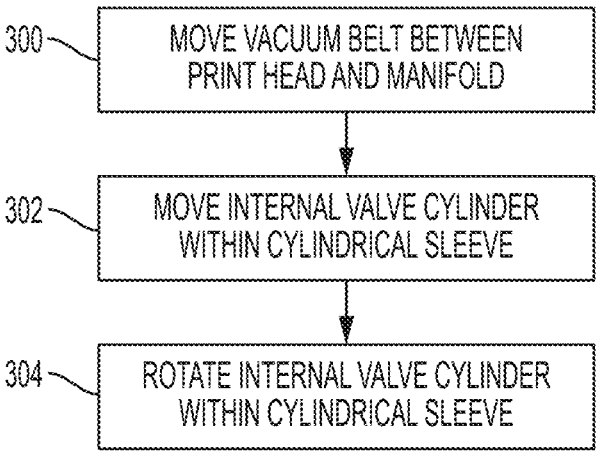
FIG. 9 is a flow diagram of various methods herein.

FIG. 9 is flowchart illustrating exemplary methods herein. In item 300, these methods move a vacuum belt having belt perforations past a print head to transport print media past the print head. Again, the print media is held on the vacuum belt by vacuum force exerted from the belt perforations. The process of moving the vacuum belt 300 moves the vacuum belt by a manifold. As discussed above, the manifold has manifold chambers, each of the manifold chambers has manifold openings, and vacuum lines are connected to the manifold chambers. The vacuum lines exert the vacuum force upon the manifold chambers, and the manifold openings exert the vacuum force through the belt perforations.

These methods linearly move an internal valve cylinder within a cylindrical sleeve in item 302. Again, the cylindrical sleeve has sleeve openings connected to the vacuum lines, and the internal valve cylinder has groups of vacuum slots exerting the vacuum force upon the vacuum lines through the sleeve openings. The process of linearly moving the internal valve cylinder 302 moves the internal valve cylinder within the cylindrical sleeve in directions parallel to cylindrical walls of the cylindrical sleeve to align only one of the groups of vacuum slots with the sleeve openings at a time, to thereby control which of the manifold chambers receive the vacuum draw.

Further, in item 304, such methods also rotate the internal valve cylinder within the cylindrical sleeve, in coordination with movement of the vacuum belt past the manifold, to limit supply of the vacuum force to only the belt perforations where the print media is held on the vacuum belt, so as to not provide the vacuum force to IDZs of the vacuum belt.

Figure 10:
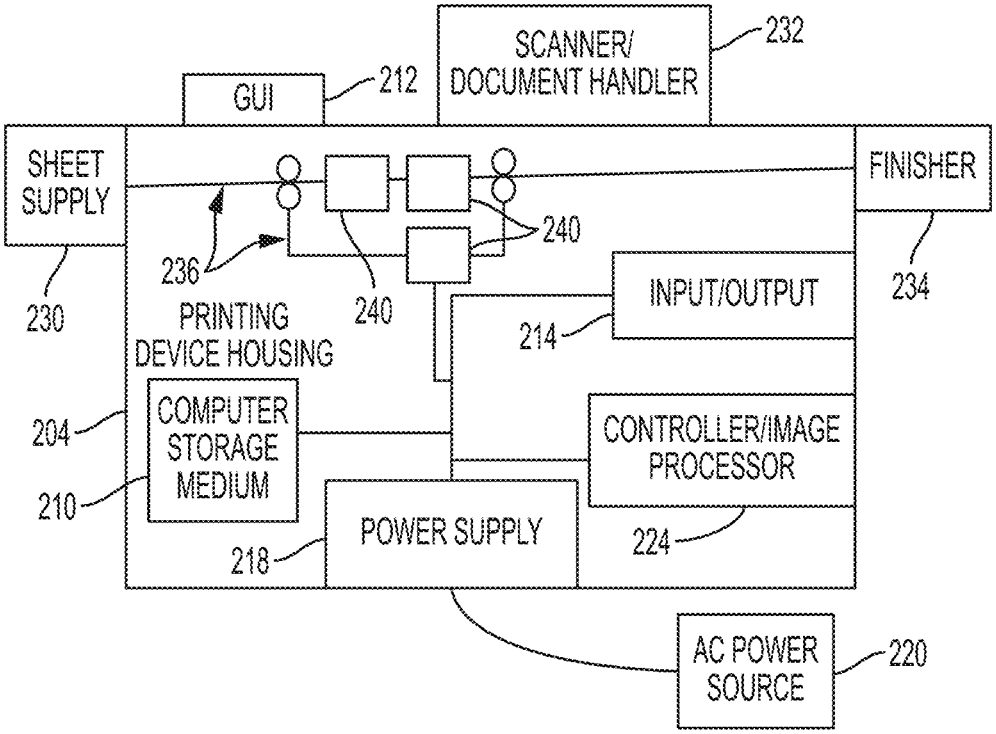
FIG. 10 is a side-view schematic diagram illustrating a printing device.

FIG. 10 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 10, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 that use marking material, and are operatively connected to a specialized image processor 224 (that is different than a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, any print heads 124 devices shown above, such as those that use electrostatic toner printers, inkjet print heads, contact print heads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a vacuum belt having belt perforations transporting sheets;

a manifold adjacent said vacuum belt, said vacuum belt moves by said manifold, said manifold has manifold chambers, and each of said manifold chambers has manifold openings;

vacuum lines connected to said manifold chambers, said vacuum lines exert vacuum force upon said manifold chambers, and said manifold openings exert said vacuum force through said belt perforations holding said sheets on said vacuum belt; and a cylindrical valve structure connected to said vacuum lines, said cylindrical valve structure comprises:

a cylindrical sleeve having sleeve openings connected to said vacuum lines; and an internal valve cylinder positioned within said cylindrical sleeve, said internal valve cylinder has groups of vacuum slots comprising grooves in a rounded body of said internal valve cylinder, said vacuum slots have a reduced radius relative to said rounded body of said internal valve cylinder, said vacuum slots have slot lengths corresponding to lengths of said sheets on said vacuum belt, and said slot lengths limit supply of said vacuum force to only ones of said belt perforations where said sheets are held on said vacuum belt, and not between said sheets.

2. The apparatus according to claim 1, said vacuum lines only receive said vacuum force from ones of said sleeve openings that are aligned with said vacuum slots.

3. The apparatus according to claim 1, rotation and linear movement of said internal valve cylinder within said cylindrical sleeve controls alignment of said sleeve openings with said vacuum slots, and controls which of said manifold chambers receive said vacuum force.

4. The apparatus according to claim 1, further comprising gaskets positioned on lateral surfaces of said internal valve cylinder between each of said groups of vacuum slots, said gaskets extend between said internal valve cylinder and said cylindrical sleeve to seal said groups of vacuum slots from each other.

5. The apparatus according to claim 1, further comprising a vacuum source connected to said internal valve cylinder, said vacuum source exerting said vacuum force upon said groups of said vacuum slots.

6. An apparatus comprising:

a vacuum belt having belt perforations transporting sheets;

a manifold adjacent said vacuum belt, said vacuum belt moves by said manifold, said manifold has manifold chambers, and each of said manifold chambers has manifold openings;

vacuum lines connected to said manifold chambers, said vacuum lines exert vacuum force upon said manifold chambers, and said manifold openings exert said vacuum force through said belt perforations holding said sheets on said vacuum belt; and a cylindrical valve structure connected to said vacuum lines, said cylindrical valve structure comprises:

a cylindrical sleeve having sleeve openings connected to said vacuum lines; and an internal valve cylinder positioned within said cylindrical sleeve, said internal valve cylinder has groups of vacuum slots comprising grooves in a rounded body of said internal valve cylinder, said vacuum slots have a reduced radius relative to said rounded body of said internal valve cylinder, said vacuum slots have slot lengths corresponding to lengths of said sheets on said vacuum belt, said internal valve cylinder rotates within said cylindrical sleeve in coordination with movement of said vacuum belt past said manifold, and said slot lengths limit supply of said vacuum force to only ones of said belt perforations where said sheets are held on said vacuum belt, and not between said sheets.

7. The apparatus according to claim 6, said vacuum lines only receive said vacuum force from ones of said sleeve openings that are aligned with said vacuum slots.

8. The apparatus according to claim 6, rotation and linear movement of said internal valve cylinder within said cylindrical sleeve controls alignment of said sleeve openings with said vacuum slots, and controls which of said manifold chambers receive said vacuum force.

9. The apparatus according to claim 6, further comprising gaskets positioned on lateral surfaces of said internal valve cylinder between each of said groups of vacuum slots, said gaskets extend between said internal valve cylinder and said cylindrical sleeve to seal said groups of vacuum slots from each other.

10. The apparatus according to claim 6, further comprising a vacuum source connected to said internal valve cylinder, said vacuum source exerts said vacuum force upon said groups of said vacuum slots.

11. A printer comprising:

a print head;

a vacuum belt having belt perforations adjacent said print head, said vacuum belt moves past said print head to transport sheets past said print head, and said sheets is held on said vacuum belt by vacuum force exerted from said belt perforations;

a manifold adjacent said vacuum belt, said vacuum belt moves between said manifold and said print head, said manifold has manifold chambers, and each of said manifold chambers has manifold openings;

vacuum lines connected to said manifold chambers, said vacuum lines exert said vacuum force upon said manifold chambers, and said manifold openings exert said vacuum force through said belt perforations holding said sheets on said vacuum belt; and a cylindrical valve structure connected to said vacuum lines, said cylindrical valve structure comprises:

a cylindrical sleeve having sleeve openings connected to said vacuum lines; and an internal valve cylinder positioned within said cylindrical sleeve, said internal valve cylinder has groups of vacuum slots comprising grooves in a rounded body of said internal valve cylinder, said vacuum slots have a reduced radius relative to said rounded body of said internal valve cylinder, said vacuum slots have slot lengths corresponding to lengths of said sheets on said vacuum belt, said internal valve cylinder rotates within said cylindrical sleeve in coordination with movement of said vacuum belt past said manifold, and said slot lengths limit supply of said vacuum force to only ones of said belt perforations where said sheets are held on said vacuum belt, and not between said sheets.

12. The printer according to claim 11, said vacuum lines only receive said vacuum force from ones of said sleeve openings that are aligned with said vacuum slots.

13. The printer according to claim 11, rotation and linear movement of said internal valve cylinder within said cylindrical sleeve controls alignment of said sleeve openings with said vacuum slots, and controls which of said manifold chambers receive said vacuum force.

14. The printer according to claim 11, further comprising gaskets positioned on lateral surfaces of said internal valve cylinder between each of said groups of vacuum slots, said gaskets extend between said internal valve cylinder and said cylindrical sleeve to seal said groups of vacuum slots from each other.

15. The printer according to claim 11, further comprising a vacuum source connected to said internal valve cylinder, said vacuum source exerts said vacuum force upon said groups of said vacuum slots.

16. A method comprising:

moving a vacuum belt having belt perforations past a print head to transport sheets past said print head, said sheets are held on said vacuum belt by vacuum force exerted from said belt perforations, said moving of said vacuum belt moves said vacuum belt by a manifold, said manifold has manifold chambers, each of said manifold chambers has manifold openings, vacuum lines are connected to said manifold chambers, said vacuum lines exert said vacuum force upon said manifold chambers, and said manifold openings exert said vacuum force through said belt perforations holding said sheets on said vacuum belt, a cylindrical sleeve has sleeve openings connected to said vacuum lines, an internal valve cylinder has groups of vacuum slots exerting said vacuum force upon said vacuum lines through said sleeve openings, said vacuum slots comprise grooves in a rounded body of said internal valve cylinder, said vacuum slots have a reduced radius relative to said rounded body of said internal valve cylinder, said vacuum slots have slot lengths corresponding to lengths of said sheets on said vacuum belt; and rotating said internal valve cylinder within said cylindrical sleeve in coordination with movement of said vacuum belt past said manifold, said slot lengths limit supply of said vacuum force to only ones of said belt perforations where said sheets are held on said vacuum belt, and not between said sheets.

17. The method according to claim 16, said vacuum lines only receive said vacuum force from ones of said sleeve openings that are aligned with said vacuum slots.

18. The method according to claim 16, further comprising linearly moving and said rotating of said internal valve cylinder within said cylindrical sleeve to control alignment of said sleeve openings with said vacuum slots, and control which of said manifold chambers receive said vacuum force.

19. The method according to claim 16, said internal valve cylinder comprises gaskets positioned on lateral surfaces of said internal valve cylinder between each of said groups of vacuum slots, said gaskets extend between said internal valve cylinder and said cylindrical sleeve to seal said groups of vacuum slots from each other.

20. The method according to claim 16, further comprising producing said vacuum force using a vacuum source connected to said internal valve cylinder, said vacuum source exerts said vacuum force upon said groups of said vacuum slots.

* * * * *